United States Patent [19]

Lebet

[11] 4,223,597

[45] Sep. 23, 1980

[54] METHOD OF THE PRODUCTION OF CIGARETTE FILTERS

[75] Inventor: Jean-Pierre Lebet, Montreaux, Switzerland

[73] Assignee: Baumgartner Papiers S.A., Crissier, Switzerland

[21] Appl. No.: 847,328

[22] Filed: Oct. 31, 1977

[30] Foreign Application Priority Data

Nov. 26, 1976 [CH] Switzerland ..... 14908/76

[51] Int. Cl.[3] ..... A24C 5/50

[52] U.S. Cl. ..... 93/77 FT; 131/261 A; 131/263

[58] Field of Search ..... 93/1 C, 77 FT; 131/261 R, 261 A, 263, 10 R, 207

[56] References Cited

U.S. PATENT DOCUMENTS

| | | | |
|---|---|---|---|
| 3,368,566 | 2/1968 | Avedikian | 131/261 R X |
| 3,370,592 | 2/1968 | Schultze et al. | 93/77 FT UX |
| 3,482,488 | 12/1969 | Sexstone | 93/1 C |
| 3,807,286 | 4/1974 | Sexstone | 93/77 FT X |

*Primary Examiner*—James F. Coan
*Attorney, Agent, or Firm*—Ernest F. Marmorek

[57] ABSTRACT

In a method of producing a cigarette filter, the filter material being visible through a filter chamber, the steps include spacing a plurality of filter elements successively apart at uniform separating distances, joining the filter elements to a continuous covering strip along a longitudinal portion thereof, so as to cover the filter elements continuously to form a filter cord having a plurality of the chambers, and so that lateral edges of the covering strip define a predetermined constant width of a slit extending over the entire length of the filter cord, and a plurality of openings extending over the separating distances, respectively, in the filter cord, sliding a filling device adapted to hold granular filter material over the openings in intimate contact with smooth surface portions of the covering strip, filling the chambers with the granular filling material, sealing the chambers upon completion of the filling step by a sealing strip, and cutting the filter cord into a plurality of individual sections.

11 Claims, 8 Drawing Figures

METHOD OF THE PRODUCTION OF CIGARETTE FILTERS

The invention relates to methods of the production of cigarette filters.

No single chamber filter suitable for cigarettes and filled with granulate, and in which the covering would allow the chamber filled with granulate to be examined, has yet appeared on the market although there is indeed a demand for such a cigarette filter. The reason is that hitherto it was not possible to pack the chambers tight with the granulate, and to avoid granulate grains passing during the filling process between the inside of the filter covering and the circumferential surface of the filter elements adjacent to the filter chamber, and becoming embedded therein. The latter cannot be used for two reasons. Firstly, it produces a very dirty appearance of the filter since the granulate used as a rule consists of black activated charcoal. Secondly, there is the troublesome side effect in which, during smoking, granulate grains in the region of the mouth-side cut the surface of the cigarette filter between the filter covering and the circumferential surface of the mouth-side filter elements pass into the smoker's mouth, which is extremely annoying.

According to the invention there is provided a method for the production of a cigarette filter provided with a chamber containing a pourable filter material, the said filter allowing the said chamber to be examined, wherein a succession of uniformly spaced apart filter elements are secured to a continuous covering strip, the filter elements are then covered over part of their circumference with the covering strip, the chambers formed thereby are next filled with pourable filter material and sealed, and the filter cord formed thereby is divided into individual sections by means of a cutting device, characterised in that in order to form a continuous covering slit of constant width that extends along the whole filter cord and is bounded by lateral filling part sliding surfaces, and to form filling openings of constant width extending over the whole distance between the individual filter elements, the filter elements are covered before filling the chambers with pourable filter material, with a covering strip consisting of a transparent material whose width is at least 75% and at most 93% of the circumference of the filter elements, and are joined to said covering strip so that the two side edges of the transparent covering strip laterally limit the covering slit and the filling openings, the filter chambers are next filled with pourable filter materials by means of a filling part extending over the covering slit and the filling openings and sliding in intimate contact on the filling part surfaces of the covering strip on the upper side of the filter cord, and after the chambers are filled with pourable filter material the covering slit is sealed by means of a sealing strip whose width is slightly greater than the width of the covering slit.

This method now makes it possible for the first time to produce chamber filters of suitable quality provided with a transparent covering and whose chambers are filled with pourable filter material, and in fact having absolutely clean filter element external surfaces, i.e. on the produced cigarette filter there is absolutely no pourable filter material between the circumferential surfaces of the filter elements limiting the filter chambers and the covering strip consisting of transparent material, since the said covering strip is securely joined to the filter elements before filling the filter chambers with the pourable filter material, and the relatively narrow filling region can be purified by removing all existing traces of the pourable filter material in a simple manner before sticking on the sealing trip.

Since known adhesives that are very suitable for sticking the sealing trip leave behind easily visible traces, it is expedient for optical reasons when using such adhesives to choose a sealing trip of an opaque material so that the adhesion of the sealing strip to the produced filter is not visable.

With an invisible adhesion it is obviously advantageous for the covering strip and the sealing strip to consist of transparent material.

When using a transparent covering strip, it is desirable to use a pourable filter material of which at least a part changes colour under the influence of certain constituents contained in the smoke, in particular those constituents that represent a health hazard for the smoker. For example, iron salts become dark on absorbing hydrogen sulphide.

When using a transparent covering strip it may also be expedient to use a pourable filter material whose parts that change colour under the influence of constituents contained in the smoke and that are harmful to the smoker's health, at least partially and preferably completely absorb, and/or chemically bind, and/or chemically convert said harmful constituents into constituents that are harmless as regards health.

The latter includes for example the oxidation of poisonous carbon monoxide into non-poisonous carbon dioxide. A coloration is also understood to include a sudden colour change.

The transparent covering material can obviously also be at least partially perforated or porous.

The invention will be further described, by way of example, with reference to the accompanying drawings, in which.

Figure 1:
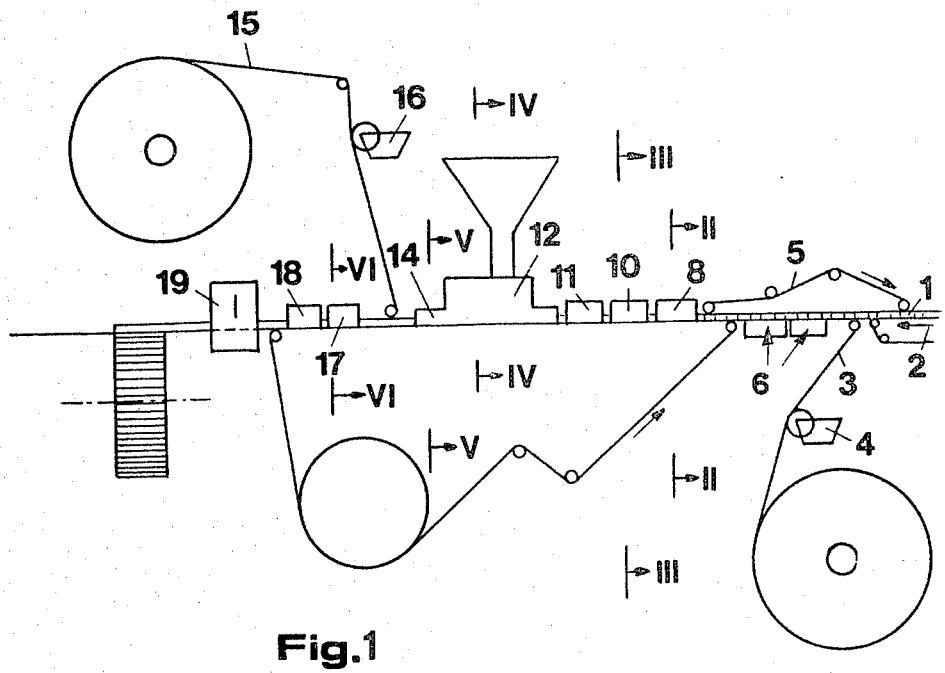
FIG. 1 is a diagrammatic side view of a device suitable for carrying out the preferred method.

As can be seen from FIG. 1, in the device illustrated the filter elements 1 consisting of cellulose or acetate are moved forwardly in the direction of the arrow 2 by means of a transporting and spacing device which orientates the filter elements in an alternating axial arrangement with respect to one another and simultaneously produces a uniform interspacing between the filter elements, as has already been known for a long time in cigarette filter manufacture.

The filter elements 1 thus axially oriented with respect to one another are then continuously laid on a likewise continuously guided covering strip 3 consisting of transparent material which has been coated at point 4 on its side coming into contact with the filter elements 1 with a heat-softening adhesive formulated for example on a wax basis, and are maintained in their relative position with respect to one another by a pressing belt 5 arranged above the covering strip 3 and running synchronously therewith, and are conveyed forwardly together with the covering strip 3. At point 6, the adhesive applied to the covering strip 3 to secure the filter elements 1 on the covering strip 3 is first softened and then solidified by means of a heating and cooling device situtated adjacent to the underside of the covering strip 3.

Figure 2:
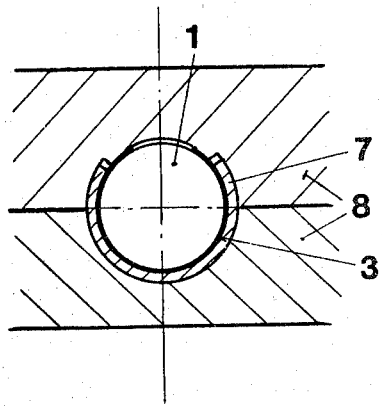
FIGS. 2 to 6 are various sections along the lines II—II to VI—VI respectively in FIG. 1.
Figure 3:
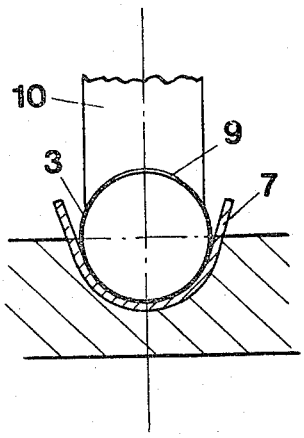

After the individual filter elements 1 have been secured to the covering strip 3, the latter is led on an endless transporting belt 7 and then all these parts are introduced together into a two-part shaping unit 8 (see FIG. 2), where the 21 mm wide covering strip 3 is laid, during its forward movement up to a filling slit 9 having a width of about 4 mm, around the filter elements 1 having a circumference of 25 mm. This formed body is then passed, by means of the transporting belt 7, first of all under a second heating element 10 (FIG. 3) situated above the upper half of the filter cord and following this directly under a second cooling element 11 likewise located above the upper half of the filter cord, to completely stick the transparent covering strip 3 to the filter elements 1 and to accurately fix the filter diameter. In this way, a continuous covering slit 9 of constant width, extending along the whole filter cord and bounded by lateral filling part sliding surfaces, and filling openings of constant width extending over the whole distance between the individual filter elements 1, are formed.

Figure 4:
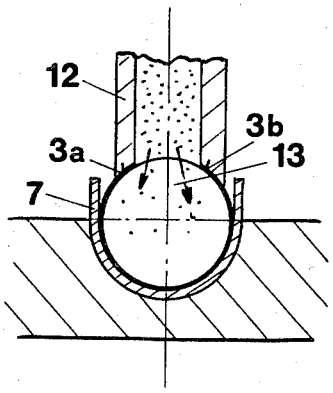

The filter cord thus formed is then passed by means of the transporting belt 7 underneath a filling part 12, which serves to introduce pourable filter material, such as activated charcoal, into the chambers 13 formed between the individual filter elements 1, and rests in a sliding and sealing manner on the filling part sliding surfaces 3*a* and 3*b* laterally limiting the filling openings, on the upper side of the filter cord, and extends over the covering slit and the filling openings of the chambers to be filled (see FIG. 4).

In order to facilitate and increase the filling of the chambers with specific pourable filter material, it may be expedient to evacuate the chambers to be filled before the filling process, as is known for example from Swiss Pat. No. 517 448 in the name of Firma F. J. Burrus & Cie., Boncourt/Switzerland.

Figure 5:
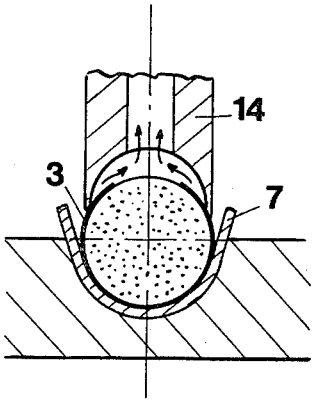

After fillig the filter chambers with pourable filter material, the filter cord passes a stripping part having an approximately semicircular stripping edge and lying on the upper surface of the filter cord, and is then passed beneath a suction part 14 (see FIG. 5) where any pulverulent filter material that may be present on the upper side of the filter cord is sucked off by means of a very slight vacuum.

Figure 6:
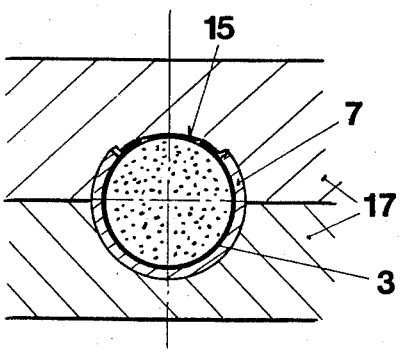
Figure 7:
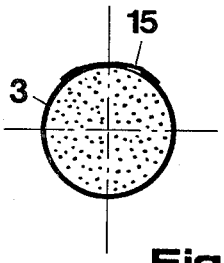
FIG. 7 is a section along the line VII—VII in FIG. 8, through a preferred cigarette filter.

After the suction part 14, a sealing strip 15 likewise consisting of transparent material and whose width is slightly greater than the width of the filling slit 9, and which is coated at the point 16 on its side coming into contact with the filter cord with a heat-softening adhesive that is colourless and transparent after solidification, is introduced from above, laid over the filling slit 9, and stuck securely by means of a heatable element 17 to the free surface of the filter elements 1 and the side edges of the transparent covering strip 3 (see FIG. 6).

In order to ensure an accurate external shape of the filter cord, the filter cord provided with the heated sealing strip 15 is passed underneath a water-cooled cooling part 18,where the adhesive of the sealing strip 15 solidifies.

After adhesion of the filter cord is complete, the latter is passed to a separating device 19 where it is subdivided in such a way that the length of the formed filter body is, as is generally known, four or six times the length of an individual filter meant for a cigarette.

Polypropylene, polyvinyl chloride or cellulose acetate film may for example be used as transparent material for the covering strip 3 and the sealing strip 15.

As already mentioned in the introduction, with such a filter allowing an unimpeded examination of the chamber filled with the pourable filter material, it is desirable to use a pourable filter material of which at least part becomes coloured under the influence of specific constituents contained in smoke, especially constituents that are a health hazard for a smoker, since in this way the smoker can optically check the effectiveness of the filter. With such an embodiment it is thus possible that part of the granulate filling the filter chambers can serve to filter the smoke passing therethrough, and the remainder thereof can serve as an optical indication of the constituents that are still present at a specific point in the filter chamber and are harmful to the smoker's health. For example, iron salts become a dark colour on absorbing hydrogen sulphide.

It is however also possible to use a pourable filter material whose parts that change colour under the influence of constituents contained in the smoke and that are harmful to the smokers health, at least partially and preferably completely absorb, and/or chemically bind, and/or chemically convert said harmful constituents into constituents that are harmless as regards health.

In order to improve the optical appearance of such a chamber filter filled with granular activated charcoal and having a transparent covering, it is also possible to employ coloured granular activated charcoal or granulated charcoal provided with a colour coating that does not affect the chemical effectiveness.

As pourable filter material, a material can also be used that contains an oxidation catalyst for oxidising carbon monoxide to carbon dioxide, of which consists of such a catalyst. In this connection, anhydrous manganese dioxide can for example be used as oxidation catalyst. Very advantageous oxidation results are obtained if 3 to 12% of copper nitrate and/or 4 to 14% of copper nitrate and/or 4 to 14% of silver nitrate are mixed with the anhydrous manganese dioxide.

Figure 8:
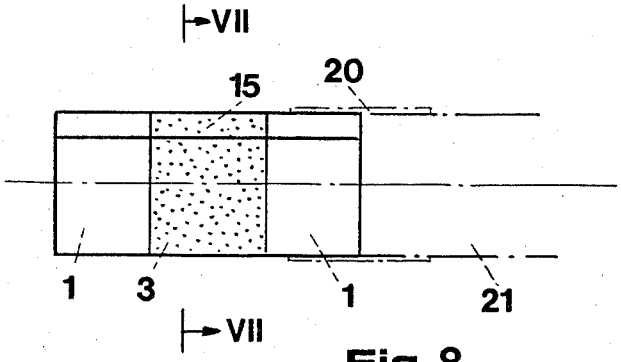
FIG. 8 is a side view of a preferred cigarette filter.

As can be seen from FIG. 8, the preferred chamber filter is joined in the usual way by means of a connecting strip 20 to the cigarette part 21 containing the tobacco.

I claim:

1. In a method of producing a cigarette filter with the aid of a continuous and transparent covering strip of a constant width and having smooth surface portions, a sealing strip of a width considerably smaller than the width of the covering strip, and a filling device adapted to hold granular filter material, said granular filling material including activated charcoal provided with a coating of paint which does not affect its chemical effectiveness, the cigarette filter being provided with a chamber for holding said granular filter material, said filter material being visible through said chamber, the steps comprising:

spacing a plurality of filter elements successively apart at uniform separating distances, said covering strip having a width within a range of 75% to 93% of the circumference of said filter elements, joining said filter elements to said continuous covering strip along a longitudinal portion thereof, so as to cover said filter elements continuously to form a filter cord having a plurality of said chambers, and so that lateral edges of said covering strip define a slit having a width slightly smaller than the width of said sealing strip, and extending over the entire length of said filter cord, as well as define a plurality of openings extending over said separating distances, respectively, in said filter cord, sliding said filling device over said openings in intimate contact with the smooth surface portions of said covering strip, filling the chambers with said granular filling material by said filling device, sealing the chambers upon completion of the filling step by said sealing strip, and cutting said filter cord into a plurality of individual sections.

2. In a method of producing a cigarette filter with the aid of a continuous and transparent covering strip of a constant width and having smooth surface portions, a sealing strip of a width considerably smaller than the width of the covering strip, and a filling device adapted to hold granular filter material, said granular filling material including anhydrous manganese dioxide and material from a group composed of 3% to 12% of copper nitrate and 4% to 14% of silver nitrate, the cigarette filter being provided with a chamber for holding said granular filter material, said filter material being visible through said chamber, the steps comprising:

spacing a plurality of filter elements successively apart at uniform separating distances, said covering strip having a width within a range of 75% to 93% of the circumference of said filter elements, joining said filter elements to said continuous covering strip along a longitudinal portion thereof, so as to cover said filter elements continuously to form a filter cord having a plurality of said chambers, and so that lateral edges of said covering strip define a slit having a width slightly smaller than the width of said sealing strip, and extending over the entire length of said filter cord, as well as define a plurality of openings extending over said separating distances, respectively, in said filter cord, sliding said filling device over said openings in intimate contact with the smooth surface portions of said covering strip, filling the chambers with said granular filling material by said filling device, sealing the chambers upon completion of the filling step by said sealing strip, and cutting said filter cord into a plurality of individual sections.

3. In a method of producing a cigarette filter with the aid of a continuous and transparent covering strip of a constant width and having smooth surface portions, a sealing strip of a width considerably smaller than the width of the covering strip, and a filling device adapted to hold granular filter material, said granular filter material including activated charcoal provided with a coating of paint which does not affect its chemical effectiveness, an acid-sensitive indicator undergoing a color change under the influence of an acid, a base-sensitive indicator undergoing a color change under the influence of a base, and an oxidation catalyst for oxidizing carbon monoxide to carbon dioxide and including anhydrous manganese dioxide and material from a group composed of 3% to 12% of copper nitrate and 4% to 14% of silver nitrate, the cigarette filter being provided with a chamber for holding said granular filter material, said filter material being visible through said chamber, the steps comprising:

spacing a plurality of filter elements successively apart at uniform separating distances, said covering strip having a width within a range of 75% to 93% of the circumference of said filter elements, joining said filter elements to said continuous covering strip along a longitudinal portion thereof, so as to cover said filter elements continuously to form a filter cord having a plurality of said chambers, and so that lateral edges of said covering strip define a slit having a width slightly smaller than the width of said sealing strip, and extending over the entire length of said filter cord, as well as define a plurality of openings extending over said separating distances, respectively, in said filter cord, sliding said filling device over said openings in intimate contact with the smooth surface portions of said covering strip, filling the chambers with said granular filter material by said filling device, sealing the chambers upon completion of the filling step by said sealing strip, and cutting said filter cord into a plurality of individual sections.

4. In a method of producing a cigarette filter with the aid of a continuous and transparent covering strip of a constant width and having smooth surface portions, a sealing strip of a width considerably smaller than the width of the covering strip, and a filling device adapted to hold granular filter material, including activated charcoal provided with a coating of paint which does not effect its chemical effectiveness, and wherein at least a portion of said granular filling material becomes colored when coming in contact with specific constituents of the smoke affecting a smoker's health, the cigarette filter being provided with a chamber for holding said granular filter material, said filter material being visible through said chamber, the steps comprising:

spacing a plurality of filter elements successively apart at uniform separating distances, said covering strip having a width within a range of 75% to 93% of the circumference of said filter elements, joining said filter elements to said continuous covering strip along a longitudinal portion thereof, so as to cover said filter elements continuously to form a filter cord having a plurality of said chambers, and so that lateral edges of said covering strip define a slit having a width slightly smaller than the width of said sealing strip, and extending over the entire length of said filter cord, as well as define a plurality of openings extending over said separating distances, respectively, in said filter cord, sliding said filling device over said openings in intimate contact with the smooth surface portions of said covering strip, filling the chambers with said activated charcoal by said filling device, sealing the chambers upon completion of the filling step by said sealing strip, and cutting said filter cord into a plurality of individual sections.

5. In a method of producing a cigarette filter with the aid of a continuous and transparent covering strip of a constant width and having smooth surface portions, a sealing strip of a width considerably smaller than the width of the covering strip, and a filling device adapted to hold granular filter material, said granular filling material including manganese dioxide and material from a group composed of 3% to 12% of copper nitrate and 4% to 10% of silver nitrate, and wherein at least a portion of said granular filling material becomes colored when coming in contact with specific constituents of the smoke affecting a smoker's health, the cigarette filter being provided with a chamber for holding said granular filter material, said filter material being visible through said chamber, the steps comprising:

spacing a plurality of filter elements successively apart at uniform separating distances, said covering strip having a width within a range of 75% to 93% of the circumference of said filter elements, joining said filter elements to said continuous covering strip along a longitudinal portion thereof, so as to cover said filter elements continuously to form a filter cord having a plurality of said chambers, and so that lateral edges of said covering strip define a slit having a width slightly smaller than the width of said sealing strip, and extending over the entire length of said filter cord, as well as define a plurality of openings extending over said separating distances, respectively, in said filter cord, sliding said filling device over said openings in intimate contact with the smooth surface portions of said covering strip, filling the chambers with said granular filling material by said filling device, sealing the chambers upon completion of the filling step by said sealing strip, and cutting said filter cord into a plurality of individual sections.

6. In a method of producing a cigarette filter with the aid of a continuous and transparent covering strip of a constant width and having smooth surface portions, a sealing strip of a width considerably smaller than the width of the covering strip, and a filling device adapted to hold granular filter material, and wherein at least a portion of said granular filling material becomes colored when coming in contact with specific constituents of the smoke affecting a smoker's health, and at least partially absorbs said constituents, the cigarette filter being provided with a chamber for holding said granular filter material, said filter material being visible through said chamber, the steps comprising:

spacing a plurality of filter elements successively apart at uniform separating distances, said covering strip having a width within a range of 75% to 93% of the circumference of said filter elements, joining said filter elements to said continuous covering strip along a longitudinal portion thereof, so as to cover said filter elements continuously to form a filter cord having a plurality of said chambers, and so that lateral edges of said covering strip define a slit having a width slightly smaller than the width of said sealing strip, and extending over the entire length of said filter cord, as well as define a plurality of openings extending over said separating distances, respectively, in said filter cord, sliding said filling device over said openings in intimate contact with the smooth surface portions of said covering strip, filling the chambers with said granular filling material by said filling device, sealing the chambers upon completion of the filling step by said sealing strip, and cutting said filter cord into a plurality of individual sections.

7. In a method of producing a cigarette filter with the aid of a continuous and transparent covering strip of a constant width and having smooth surface portions, a sealing strip of a width considerably smaller than the width of the covering strip, and a filling device adapted to hold granular filter material, and wherein at least a portion of said granular filling material becomes colored when coming in contact with specific constituents of the smoke affecting a smoker's health and at least partially binds said specific constituents, the cigarette filter being provided with a chamber for holding said granular filter material, said filter material being visible through said chamber, the steps comprising:

spacing a plurality of filter elements successively apart at uniform separating distances, said covering strip having a width within a range of 75% to 93% of the circumference of said filter elements, joining said filter elements to said continuous covering strip along a longitudinal portion thereof, so as to cover said filter elements continuously to form a filter cord having a plurality of said chambers, and so that lateral edges of said covering strip define a slit having a width slightly smaller than the width of said sealing strip, and extending over the entire length of said filter cord, as well as define a plurality of openings extending over said separating distances, respectively, in said filter cord, sliding said filling device over said openings in intimate contact with the smooth surface portions of said covering strip, filling the chambers with said granular filling material by said filling device, sealing the chambers upon completion of the filling step by said sealing strip, and cutting said filter cord into a plurality of individual sections.

8. In a method of producing a cigarette filter with the aid of a continuous and transparent covering strip of a constant width and having smooth surface portions, a sealing strip of a width considerably smaller than the width of the covering strip, and a filling device adapted to hold granular filter material, and wherein at least a portion of said granular filling material becomes colored when coming in contact with specific constituents of the smoke affecting a smoker's health, and converts said specific constituents into constituents which do not effect a smoker's health, the cigarette filter being provided with a chamber for holding said granular filter material, said filter material being visible through said chamber, the steps comprising:

spacing a plurality of filter elements successively apart at uniform separating distances, said covering strip having a width within a range of 75% to 93% of the circumference of said filter elements, joining said filter elements to said continuous covering strip along a longitudinal portion thereof, so as to cover said filter elements continuously to form a filter cord having a plurality of said chambers, and so that lateral edges of said covering strip define a slit having a width slightly smaller than the width of said sealing strip, and extending over the entire length of said filter cord, as well as define a plurality of openings extending over said separating distances, respectively, in said filter cord, sliding said filling device over said openings in intimate contact with the smooth surface portions of said covering strip, filling the chambers with said granular filling material by said filling device, sealing the chambers upon completion of the filling step by said sealing strip, and cutting said filter cord into a plurality of individual sections.

9. In a method of producing a cigarette filter with the aid of a continuous and transparent covering strip of a constant width and having smooth surface portions, a sealing strip of a width considerably smaller than the width of the covering strip, and a filling device adaped to hold granular filter material, said granular filling material containing an acid-sensitive indicator undergoing a color change under the influence of an acid, and wherein at least a portion of said granular filling material becomes colored when coming in contact with specific constituents of the smoke affecting a smoker's health, the cigarette filter being provided with a chamber for holding said granular filter material, said filter material being visible through said chamber, the steps comprising:

spacing a plurality of filter elements successively apart at uniform separating distances, said covering strip having a width within a range of 75% to 93% of the circumference of said filter elements, joining said filter elements to said continuous covering strip along a longitudinal portion thereof, so as to cover said filter elements continuously to form a filter cord having a plurality of said chambers, and so that lateral edges of said covering strip define a slit having a width slightly smaller than the width of said sealing strip, and extending over the entire length of said filter cord, as well as define a plurality of openings extending over said separating distances, respectively, in said filter cord, sliding said filling device over said openings in intimate contact with the smooth surface portions of said covering strip, filling the chambers with said granular filling material by said filling device, sealing the chambers upon completion of the filling step by said sealing strip, and cutting said filter cord into a plurality of individual sections.

10. In a method of producing a cigarette filter with the aid of a continuous and transparent covering strip of a constant width and having smooth surface portions, a sealing strip of a width considerably smaller than the width of the covering strip, and a filling device adapted to hold granular filter material, said filling material containing a base-sensitive indicator undergoing a color change under the influence of a base, and wherein at least a portion of said granular filling material becomes colored when coming in contact with specific constituents of the smoke affecting a smoker's health, the cigarette filter being provided with a chamber for holding said granular filter material, said filter material being visible through said chamber, the steps comprising:

spacing a plurality of filter elements successively apart at uniform separating distances, said covering strip having a width within a range of 75% to 93% of the circumference of said filter elements, joining said filter elements to said continuous covering strip along a longitudinal portion thereof, so as to cover said filter elements continuously to form a filter cord having a plurality of said chambers, and so that lateral edges of said covering strip define a slit having a width slightly smaller than the width of said sealing strip, and extending over the entire length of said filter cord, as well as define a plurality of openings extending over said separating distances, respectively, in said filter cord, sliding said filling device over said openings in initmate contact with the smooth surface portions of said covering strip, filling the chambers with said granular filling material by said filling device, sealing the chambers upon completion of the filling step by said sealing strip, and cutting said filter cord into a plurality of individual sections.

11. A cigarette filter produced with the aid of a continuous and transparent covering strip of a constant width and having smooth surface portions, a sealing strip of a width considerably smaller than the width of the covering strip, and a filling device adapted to hold granular filter material, the cigarette filter being provided with a chamber for holding said granular filter material, said filter material being visible through said chamber, the steps in producing said cigarette filter comprising:

spacing a plurality of filter elements successively apart at uniform separating distances, said covering strip having a width within a range of 75% to 93% of the circumference of said filter elements, joining said filter elements to said continuous covering strip along a longitudinal portion thereof so as to cover said filter elements continuously to form a filter cord having a plurality of said chambers, and so that lateral edges of said covering strip define a slit having a width slightly smaller than the width of said sealing strip and extending over the entire length of said filter cord, as well as define a plurality of openings extending over said separating distances, respectively, in said filter cord, sliding said filling device over said openings in initmate contact with the smooth surface portions of said covering strip, filling the chambers with said granular filling material by said filling device, sealing the chambers upon completion of the filling step by said sealing strip, and cutting said filter cord into a plurality of individual sections.

* * * * *